US005236348A

United States Patent [19]

Fetherolf et al.

[11] Patent Number: 5,236,348

[45] Date of Patent: Aug. 17, 1993

[54] PRINTER PAPER STATUS INDICATOR

[75] Inventors: Willis G. Fetherolf, Boise; Robin P. Yergenson, Meridian, both of Id.

[73] Assignee: Hewlett-Packard Company, Palo Alto, Calif.

[21] Appl. No.: 957,313

[22] Filed: Oct. 6, 1992

[51] Int. Cl.[5] ..... B41J 29/18

[52] U.S. Cl. ..... 400/703; 116/303; 221/6; 271/127

[58] Field of Search ..... 400/703, 708, 710, 711, 400/712, 624, 627; 271/126, 127, 157, 158, 159; 202/459, 525; 203/546, 551; 221/2, 3, 6; 116/303, 305, 333, 200, 234, 284, 289, 296; 312/234

[56] References Cited

U.S. PATENT DOCUMENTS

| | | | |
|---|---|---|---|
| 3,260,402 | 7/1966 | Lareau et al. | 221/6 |
| 4,323,316 | 4/1982 | Fowler et al. | 400/703 |
| 4,655,626 | 4/1987 | Okazaki | 400/624 |
| 4,888,617 | 12/1989 | Okuzawa | 271/127 |
| 4,958,950 | 9/1990 | Kobayashi et al. | 400/624 |
| 5,019,839 | 5/1991 | Watanabe et al. | 400/624 |
| 5,177,544 | 1/1993 | Kimura et al. | 400/624 |

FOREIGN PATENT DOCUMENTS

| | | | |
|---|---|---|---|
| 20973 | 8/1905 | Austria | 116/303 |
| 0028398 | 2/1983 | Japan | 400/703 |
| 0059566 | 3/1988 | Japan | 400/703 |

OTHER PUBLICATIONS

"Paper-Low Indicator for Sheet Pack Feed for Typewriters" IBM Tech. Discl. Bulletin, vol. 24, No. 5, Oct. 1981, pp. 2277-2278.

"Bill Cartridge with Indications of Improper Bill Loading" IBM Tech. Discl. Bulletin, vol. 28, No. 7, Dec. 1985, pp. 3056-3057.

"End of Stack Mechanism" IBM Tech. Discl. Bulletin, vol. 30, No. 4, Sep. 1989, pp. 1460-1462.

"Indicating Spring Holder" IBM Tech. Discl. Bulletin, vol. 28, No. 6, Nov. 1985, pp. 2549-2550.

"Paper Supply Sensing for Edge Erase & Other Copier Control Response," IBM Tech. Discl. Bulletin, vol. 23, No. 7B, Dec. 1980, pp. 3139-3141.

*Primary Examiner*—Eugene H. Eickholt

[57] ABSTRACT

An imprinting mechanism includes a sheet tray and comprises a housing and a spring bias device within the housing. A sheet stack support is positioned within the housing and in contact with the spring bias, the spring bias forcing the sheet stack support towards a first position, the sheet stack support being forced (against the spring bias) to a second position when a stack of sheets is positioned thereon. A pivotally mounted indicator is positioned within the housing and includes first and second arm portions, a first portion being in contact with a surface of the sheet stack support and a second portion movable between visible and invisible locations, as viewed by a user. The first portion is movable about the pivot to position the second portion to the visible location when a predetermined size stack of sheets remain in the sheet stack support. The indicator is constructed of a single piece of molded plastic and its second portion exhibits greater mass than its first so that no spring or other bias device is required in its operation.

6 Claims, 2 Drawing Sheets

PRINTER PAPER STATUS INDICATOR

FIELD OF THE INVENTION

This invention relates to sheet imprinting mechanisms, and more particularly to a device for indicating when a supply of sheets in the imprinting mechanism diminishes to a predetermined level.

BACKGROUND OF THE INVENTION

Copiers, laser printers, ink jet printers and other imprinting mechanisms today incorporate an ability to store and supply sheets of paper from a stack stored within their covers. As such, the sheet stack is invisible to the user. Normally, the only indication the user receives of a paper-out status is a signal when the paper supply has actually been exhausted. In many cases, that signal issues during a printing or copying job and requires that the job be interrupted to re-supply the paper stack. It is preferable that such a signal be given at a time that enables the user to interrupt the copying or print job at a convenient point, replenish the stack and continue the job.

Some prior art sheet status indicators display the sheet supply status by means of an indicator in or behind a slot in the wall of a cassette that supports the sheets. This type of indicator is continually visible to the operator and is often ignored due to its continuous visibility.

Accordingly, it is an object of this invention to provide an improved sheet supply status indicator for an imprinting mechanism.

It is another object of this invention to provide a sheet supply status indicator that provides a visible indication when a sheet supply falls to a predetermined level.

It is still another object of this invention to provide a sheet supply status indicator that provides an ability to indicate an incipient supply exhaustion at any desired level of remaining sheets.

It is still another object of this invention to provide a sheet supply status indicator that is of simple construction and does not effect the operation of a sheet cassette tray with which it is associated even when it is inadvertently moved by a user.

SUMMARY OF THE INVENTION

An imprinting mechanism includes a sheet tray and comprises a housing and a spring bias device within the housing. A sheet stack support is positioned within the housing and in contact with the spring bias, the spring bias forcing the sheet stack support towards a first position, the sheet stack support being forced (against the spring bias) to a second position when a stack of sheets is positioned thereon. A pivotally mounted indicator is positioned within the housing and includes first and second arm portions, a first portion being in contact with a surface of the sheet stack support and a second portion movable between visible and invisible locations, as viewed by a user. The first portion is movable about the pivot to position the second portion to the visible location when a predetermined size stack of sheets remain in the sheet stack support. The indicator is constructed of a single piece of molded plastic and its second portion exhibits greater mass than its first so that no spring or other bias device is required in its operation.

DETAILED DESCRIPTION OF THE INVENTION

Hereafter, the invention will be described in the context of a laser printer having a removable paper tray, however, it is to be understood that the invention is usable with any imprinting or sheet handling mechanism wherein a sheet supply status indication is desired. Furthermore, while the invention will be described in the context of a paper handling mechanism, it is to be understood that any type of sheet stock may be included therewith.

Figure 1:
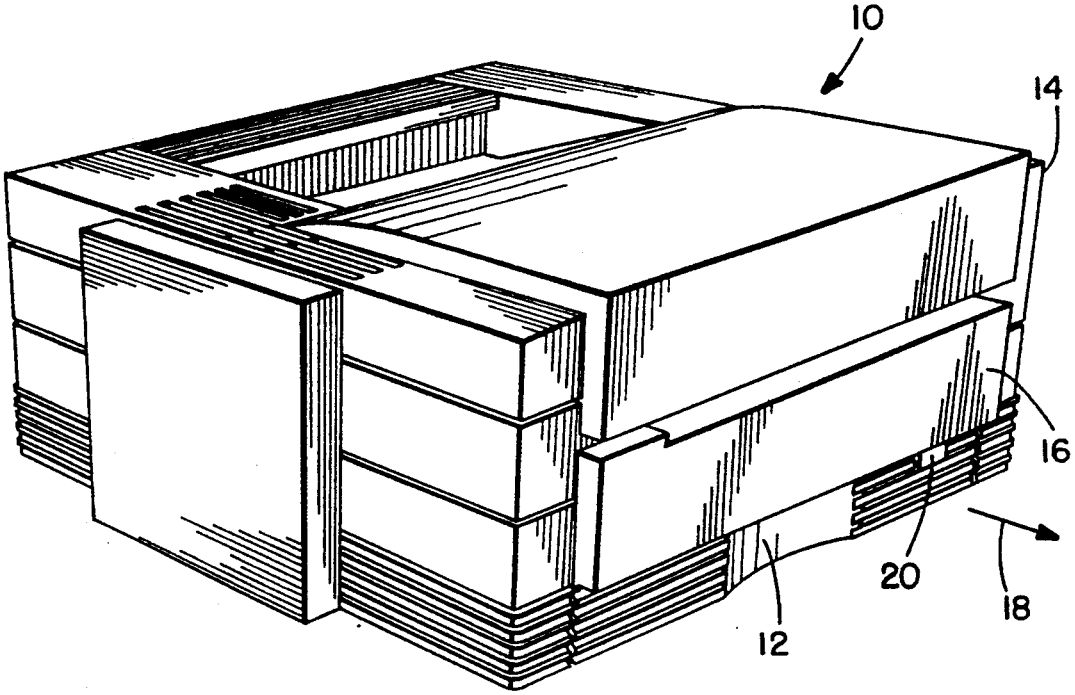
FIG. 1 is an isometric view of a print mechanism showing the relationship of a sheet tray to the overall mechanism.

Referring now to FIG. 1, a printer 10 includes a cassette tray 12 that is slidable in relationship to housing 14. In order to replace a paper stack within paper tray 12, a user grasps upper portion 16 of tray 12 and pulls it in the direction of arrow 18. The withdrawal of tray 12 from housing 14 exposes the paper stack and enables its replenishment. When the paper stack reaches a predetermined level within paper tray 12, an indicator 20 drops down from behind upper portion 16 and becomes visible to the user. Indicator 20 signals the user that the paper supply has reached a predetermined level.

Figure 2:
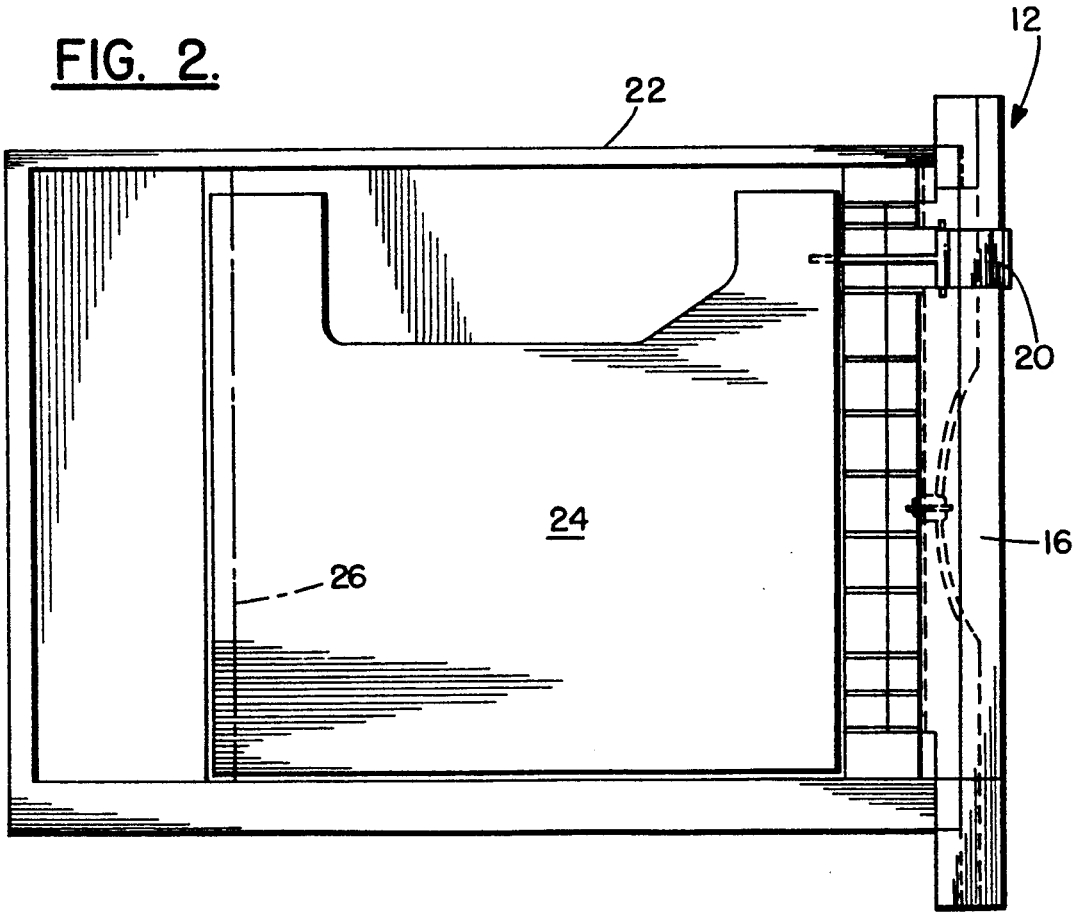
FIG. 2 is a plan view of the sheet tray.
Figure 3:
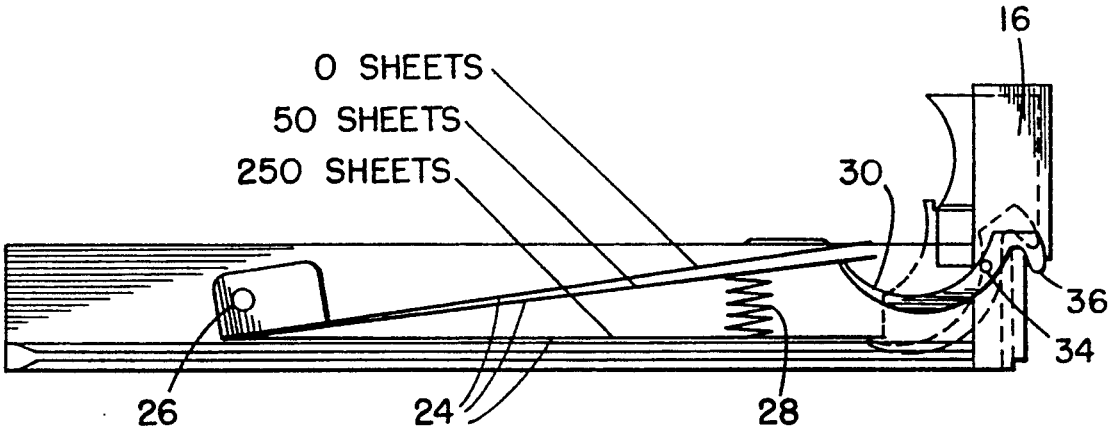
FIG. 3 is a schematic sectional view of the sheet tray of FIG. 2 taken along line A—A.
Figure 4A:
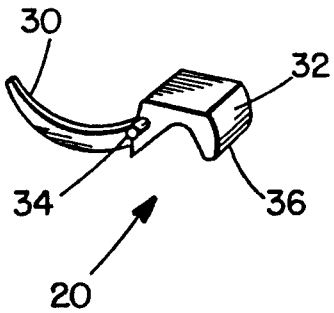
FIG. 4A is an isometric view of the indicator mechanism.
Figure 4B:
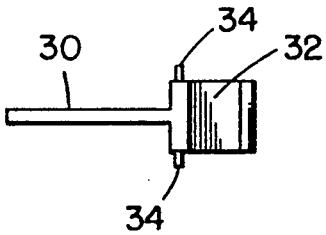
FIG. 4B is a plan view of the indicator mechanism.
Figure 4C:
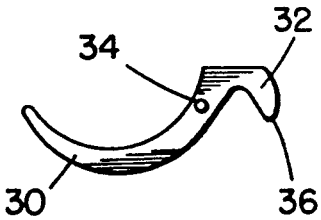
FIG. 4C is a side view of the indicator mechanism.

Referring to FIGS. 2 and 3, details of paper tray 12 will be described. Paper tray 12 comprises a frame portion 22 in which a movable sheet stack support 24 is positioned. Support 26 is pivotally mounted at axis 26 (see FIG. 3) and is adapted to support a stack of paper thereon. A spring bias 28 (schematically shown in FIG. 3) biases support 24 in an upward direction so that whatever sheets of paper are present thereon are brought into engagement with a sheet feed mechanism within printer 10 (not shown). In FIG. 3, the position of support 24 is shown when it is loaded with zero sheets of paper, fifty sheets of paper, and two hundred fifty sheets of paper.

An Indicator 20 is a pivotally mounted, molded plastic piece that is shown in greater detail in FIGS. **4*a*–4*c*. Indicator 20 comprises three portions, a curved arm 30, an arcuately shaped portion 32, and pivots 34. The mass of portion 32 is greater than that of arm 30 so that when indicator 20 is mounted by pivots 34, the weight of portion 32 moves arm 30** in a clockwise direction.

As shown in FIGS. 2 and 3, indicator 20 is pivotally mounted within tray 12 so that arm 30 bears upon the underside of stack support 24. Portion 34 of indicator 20, when mounted as shown in FIG. 3, rotates about pivots 34 so as to expose its lower extremity 36 through a window (not shown) in the underside of upper portion 16 of tray 12. The shaded version of indicator 20 shows its orientation when stack support 24 is fully depressed by a full stack of paper. In such a state, tip 36 is hidden from view behind upper portion 16 of tray 12. When tray 24 is elevated by spring 20 as a result of a depletion of the paper stack, the greater weight of portion 32 of indicator 20 causes arm 30 to follow the movement of stack support 24.

As can be seen, tip 36 of indicator 20 becomes exposed when the position of stack support 24 reaches a predefined inclination with respect to axis 26. By properly adjusting the shapes of arm 30 and portion 32 of indicator 20, tip 36 can become visible at any desired level of remaining sheet supply. Preferably, it becomes visible when some paper still remains on stack support 24. It is to be noted that the weight distribution of indicator 20 about pivot 34 enables elimination of any spring bias or other mechanism. Furthermore, should the user attempt to lift tip 36, such action merely brings arm 30 out of contact with stack support 24 and does not affect its operation.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A mechanism having a sheet supply tray, the mechanism comprising:

a housing;

spring bias means within said housing;

sheet stack support means within said housing in contact with said spring bias means, said spring bias means forcing said sheet stack support means towards a first position, said sheet stack support means being forced against said spring bias means to a second position when a sheet stack is positioned thereon; and pivotally mounted indicator means having first and second arm portions, a first arm portion in contact with a surface of said sheet stack support means and a second portion movable between visible and invisible locations as viewed by a user, said first arm portion movable to position said second portion to said visible location when a predetermined size stack of sheets is present on said sheet stack support means.

2. The mechanism as recited in claim 1 wherein said spring bias means bears upon a lower surface of said sheet stack support means and said first arm portion of said indicator means also bears upon said lower surface.

3. The mechanism as recited in claim 2 wherein said second portion of said indicator is of greater mass than said first arm portion and creates a moment about a pivot to cause said first portion to bear upon said lower surface of said sheet stack support means.

4. The mechanism as recited in claim 3 wherein said indicator means is pivotally mounted in a fixed relation with respect to movements of said sheet stack support means.

5. The mechanism as recited in claim 4 wherein said second portion is arcuately shaped and exhibits an end tip, said end tip extending through an aperture in said housing when said predetermined sheet stack size is present on said sheet stack support means.

6. The mechanism as recited in claim 5 wherein said indicator means comprises a molded unitary plastic part, said indicator means including pivots extending therefrom for mounting in said sheet supply tray.

* * * * *